US005084309A

United States Patent [19]

Smith et al.

[11] Patent Number: 5,084,309

[45] Date of Patent: Jan. 28, 1992

[54] PRODUCT PRESENTING DIFFERENT ARTISTIC IMAGES IN THE PRESENCE AND ABSENCE OF AMBIENT LIGHT AND FABRICATION METHOD THEREFOR

[75] Inventors: Lou E. Smith, Manitou Springs; David W. Box, Colorado Springs, both of Colo.

[73] Assignees: Timothy J. Martin; Russell C. Cline, both of Lakewood, Colo. ; a part interest

[21] Appl. No.: 493,203

[22] Filed: Mar. 14, 1990

[51] Int. Cl.[5] ..... B44F 1/10; B05D 5/06

[52] U.S. Cl. ..... 428/29; 156/250; 427/157; 427/411; 428/33; 428/203; 428/690

[58] Field of Search ..... 427/157, 411; 428/29, 428/33, 203, 240, 690; 156/250

[56] References Cited

U.S. PATENT DOCUMENTS 4,211,813 7/1980 Grauisse et al. ..... 427/157

4,652,464 3/1987 Ludlum et al. ..... 427/157

*Primary Examiner*—James J. Seidleck

*Attorney, Agent, or Firm*—Timothy J. Martin; Dana S. Rewoldt

[57] ABSTRACT

The invention includes a product and a fabrication method for generating one image in the presence of ambient light and a second different image in the absence of ambient light. This invention can use phosphorescent material to form one of the images. This invention is particularly related to puzzles or novelty artwork for children.

29 Claims, 3 Drawing Sheets

PRODUCT PRESENTING DIFFERENT ARTISTIC IMAGES IN THE PRESENCE AND ABSENCE OF AMBIENT LIGHT AND FABRICATION METHOD THEREFOR

FIELD OF THE INVENTION

The present invention generally relates to artistic presentations of images, but the present invention specifically is directed to a product and fabrication method therefor wherein different images may be seen in the presence and absence of ambient light. As such, the present invention is particularly directed to the field of novelty artwork and puzzles especially suited for children.

BACKGROUND OF THE INVENTION

One of the most challenging and rewarding aspects involved in the raising and teaching of children may be found in encouraging the development of a child's imagination. The cognitive value of creative thought is difficult to overstate. Included in this challenge, though, is the ability to entertain the child while, at the same time, to encourage the imagination.

It is well known that children often become increasing difficult to entertain in the latter hours of the day, specifically approaching bedtime. This difficulty with respect to many children derives from two factors. First, as children become more tired, they tend to be fussier and more resistive to parental guidance and suggestions. Second, many children exhibit inherent fear of the dark. This fear, while having different levels of intensity, nonetheless causes a child to forestall bedtime as long as possible. For these reasons, among others, it is recommended that parents or other guardians of children regularly spend an interval of time before bedtime that is dedicated solely to interaction with the child. Since it is desirable that this interval be spent in quieter activities, relatively few avenues are available for quiet interaction with the child. Perhaps most common among these activities is the reading of a book or other story telling with the child. The present invention recognizes the need to provide alternate activities for children that are especially suitable prior to bedtime and further response to the comforting of a child in the dark. As described more fully in this application, the present invention utilizes overlay images, one of which is visible in ambient light and the other of which luminesces.

The use of phosphorescent materials and photoluminescent materials certainly pre-dates to present invention. In the past, however, these materials have been used for luminous dials, glow-in-the-dark posters, warning decals and the like. The use of a phosphorescent material is known in one instance to be incorporated in story books wherein a portion of a picture may be represented by a pigment of the phosphorescent material disposed in the substrate whereby certain components of the picture image will glow in the dark. In other instances, phosphorescent pigments may be applied to or molded with toys or other objects so as to cause portions of those objects to glow in the dark, as well.

The present invention recognizes the need to extend the uses of phosphorescent materials in a novel manner that creates a product that further stimulates the imagination of the child. This product provides different images on a common substrate which may be linked by a theme whereby the image transforms between different light conditions thereby stimulating the child's imagination while at the same time providing a comforting object which a child may enjoy in the dark.

SUMMARY OF THE INVENTION

It is an object of the present invention to provide a product and fabrication therefore wherein two somewhat different images are represented on the picture with one of these images being visible in ambient light while the other image luminescent so as to be visible in the absence of ambient light.

Another object of the present invention is to provide a product and fabrication method for a picture whereby two different images are presented, one in ambient light and which luminescence, such that the two images have some common image forming elements and some different image forming elements to provide a linked theme for the two images.

A further object of the present invention is to provide a product and fabrication therefore which stimulates the imagination of a child by having different images, one of which is visible in daylight or artificial light and the other of which glows in the dark show a different scene incorporating common image forming elements oriented differently with respect to one another between the two images.

Yet a further object of the present invention is to provide a product and fabrication method therefor to create a picture which will comfort children at bedtime and when the child's room is dark.

Still a further object of the present invention is to provide a puzzle product for a child that may be assembled to reveal one image in ambient light yet, when the lights are extinguished, presents a different related image.

According to the present invention, then, a product is provided which is in the form of a picture that is viewable under different light conditions to show different images. Broadly, this product comprises a substrate on which a first and second image is disposed. The first image is disposed on the substrate is a plurality of first image forming elements which are created by a first image forming material so that the first image may be viewed under the presence of ambient light in the visible spectrum. The second image is disposed on the substrate by a second image forming materials which overlays the first image. This second image forming material is substantially clear and includes a phosphorescent material which is excited by the presence of ambient light to luminesce in the visible spectrum.

In order that the second image be visible, for example, to a child at bedtime, the phosphorescent material is selected to be one which has a decay rate sufficiently low so that it visibly luminesce and is perceivable one hour or more after removal of the source of excitation. Preferably, the phosphorous material includes a clear carrier compound and phosphorous crystals entrained therein. The clear carrier compound is preferably selected from group consisting of: polyurethane resins, enamels, varnishes, polyvinylchlorides and polymers. The second image forming material comprises, preferably, between 5%–30% by weight of the phosphorescent crystals. The substrate may be any suitable substrate on which images are normally disposed in the field of art, and may readily be selected from a group consisting of paper, wood, cloth, leather, ceramic, plastic and vinyl.

The first image is preferable a rending in multi-color format, such as four color ink printing, wherein some of the first image forming elements are light pigment in colors and some of the first image forming elements are created out of dark pigmented colors. In such case, the second image forming materials predominantly overlays the light pigmented colors. To this end also, some of the first and second image forming elements are selected to have co-extensive boundary portions. Further, in order to help bond the second image forming material to the substrate, an intermediate layer of a third material may be disposed on the substrate between the substrate and the second image forming material as an undercoat therefor. The intermediate layer comprises a substance that compatibly bonds to both the substrate and the second image forming material. Further, if desired, the substrate may be separated into a plurality of puzzle pieces so that the product is in the form of a jigsaw puzzle. To this end also, a backing panel may be laminated onto the substrate opposite the first and second images.

A fabrication method is also described for creating a picture exhibiting different images in the presence and absence of ambient light. Broadly, a method of the present invention comprises the steps of producing a primary image of plurality of first image forming elements on a substrate and then overlaying the primary image with a substantially clear phosphorescent material to thereby create a secondary image that is different from the primary image with the secondary image being formed of a plurality of second image forming elements. At least some of the second image forming elements may be superimposed over the first image forming elements. Thus, the primary image is visible in ambient light and the secondary image is visible in the absence of ambient light. This method may include the step of placing an intermediate layer of clear bonding material on the substrate prior to overlaying the primary image with the phosphorous material so as to facilitate bonding of the phosphorescent material to the substrate. If desired, the disposition of the primary image may be in any suitable manner, such as four color offset printing. The phosphorescent material may be screen printed on the substrate. If desired, some of the first and second image forming elements may have common boundary portions. Where a puzzle is desired, the method further includes the step of cutting the substrate into puzzle pieces after producing the primary image thereon and after overlaying the primary image with the secondary image. Prior to cutting the substrate into puzzle pieces, a backing panel may be laminated to the substrate.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 1(*b*) is a top plan view of the product shown in FIG. 1(*a*) in the absence of ambient light with the product luminescing to show a second image comprising second image forming elements;

FIG. 1(*c*) is a top plan view of the product shown in FIGS. 1(*a*) and 1(*b*) showing light and dark color regions for the first image in diagrammatic form and showing the second image forming elements in phathom;

FIG. 1(*d*) shows the product shown in FIGS. 1(*a*) and 1(*b*) as separated into pieces forming a jigsaw puzzle forming pieces;

FIG. 3(*b*) shows the image portion of FIG. 3(*a*) in the absence of ambient light luminescing to show a second image.

DETAILED DESCRIPTION OF THE EXEMPLARY EMBODIMENTS

Figure 1A:
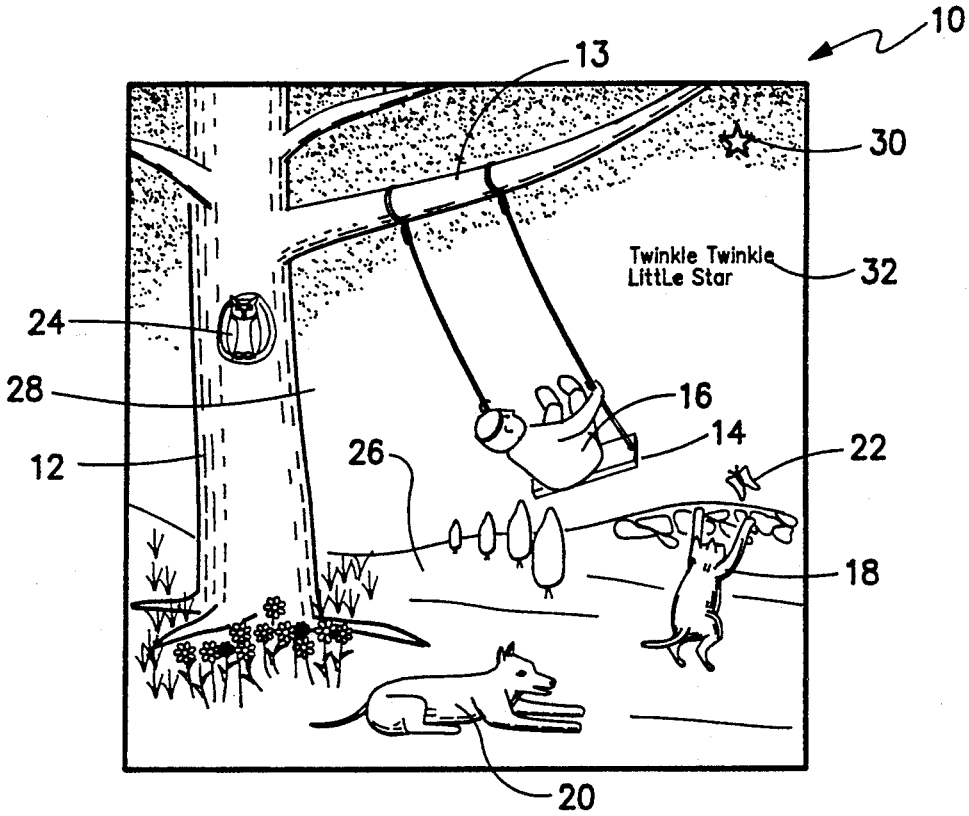
FIG. 1(*a*) is a top plan view of the product according the the present invention shown under ambient light so that a first image comprising first image forming elements are observable.
Figure 1B:
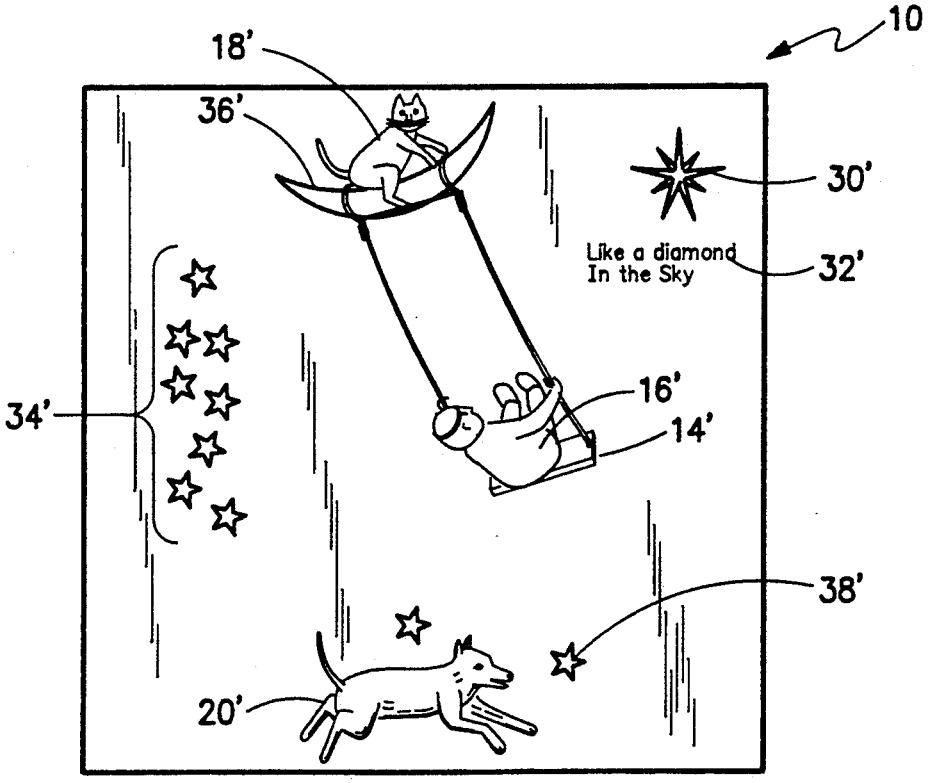
Figure 1C:
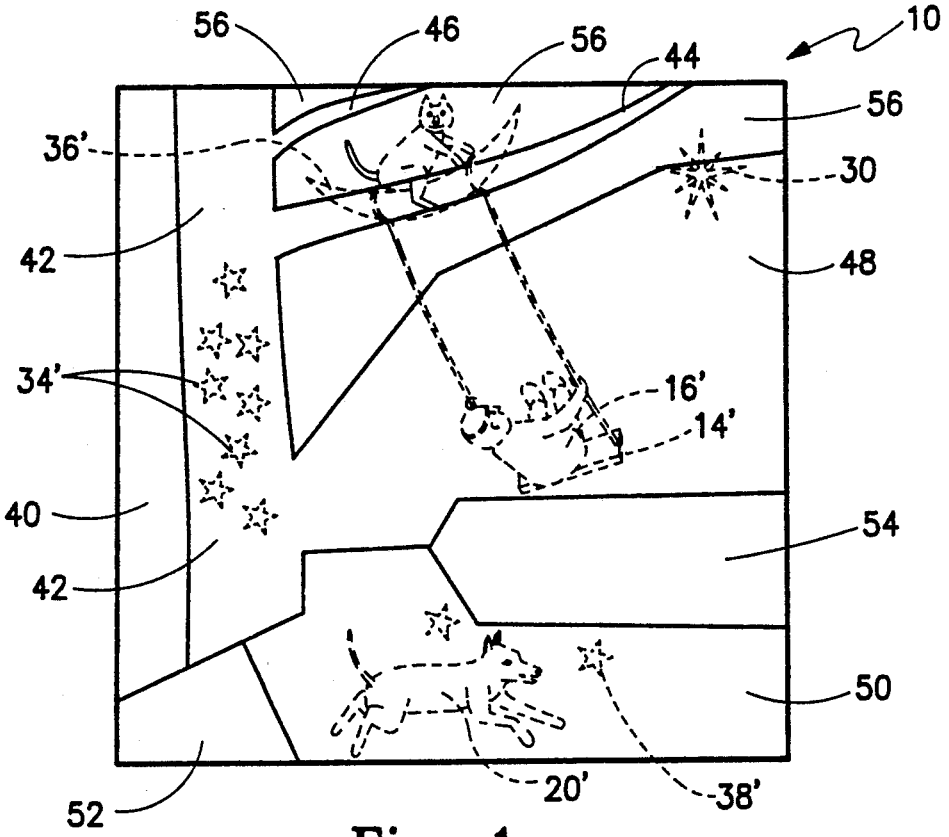
Figure 1D:
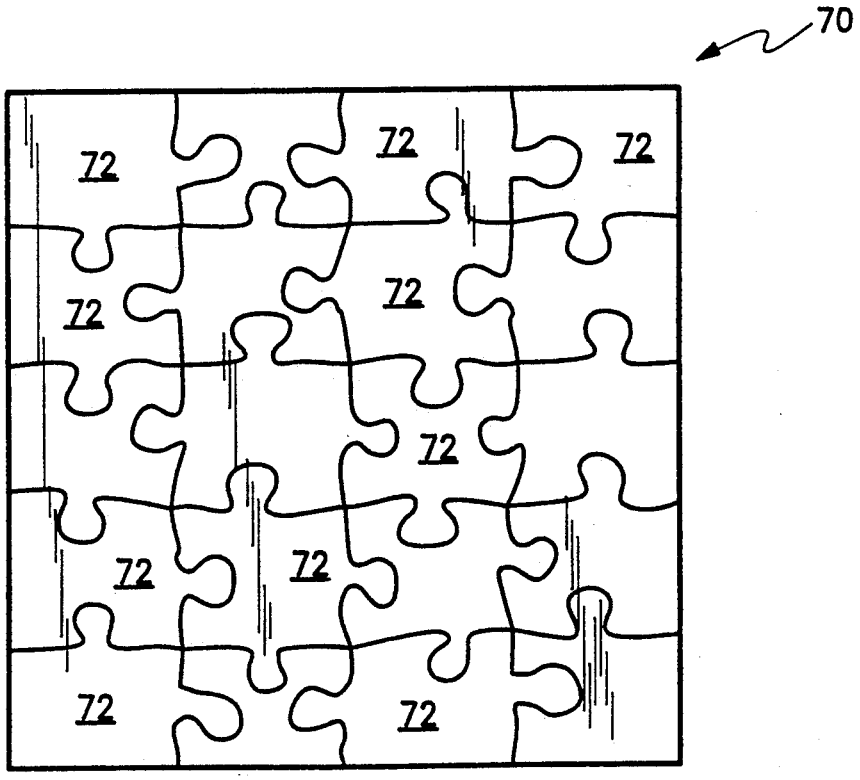

The present invention is directed to a product and a fabrication method to produce pictures wherein each such picture has both a primary and a secondary image respectively viewable in the presence and absence of ambient light. To this end, the primary image is created by first image forming elements, and the secondary image is likewise constructed of second image forming elements. The material used to form the secondary image, though, is a phosphorescent material that luminesces after being excited by a source of ambient light so as to be viewable in the absence of ambient light.

It should be appreciated at the outset that the present invention is described with specific reference to exemplary embodiments however, the use of these embodiments for representative purposes is by no means in limitation to the products and techniques described herein. To this end, then, by way of illustration, a first embodiment of the present invention is best shown in FIGS. 1(*a*)–1(*d*) and in FIG. 2. Here it may be seen that a product 10 carries a first or primary image shown in FIG. 1(*a*) as a pastoral scene and a second or secondary image shown in FIG. 1(*b*) as a celestial scene. With reference to FIG. 1(*a*), product 10 presents a first scene or image which is disposed thereon by a plurality of first image forming elements, for example, as illustrations in the form of a tree 12, a swing 14, a child 16 seated in swing 14, a cat 18, a dog 20, a butterfly 22, an owl 24, land area 26, sky area 28 and star 30 in sky area 28. If desired, text material, such as words 32 may also be included with the illustrations. With reference to FIG. 1(*b*) it may be seen that a second scene or second image is formed by second image forming elements which can include some elements which correspond to the first image forming elements shown in FIG. 1(*a*) but with these elements, in certain instances, correlated in different positions and views. Thus, for example, the secondary image shown in FIG. 1(*b*) can include swing 14', child 16', cat 18', dog 20', star 30', and secondary text material 32'. In addition, this secondary image can include second image forming elements, such as stars 34' and moon 36', which are not correlated to the first image forming elements shown in FIG. 1(*a*).

In comparing FIG. 1(*b*) to FIG. 1(*a*), it may be seen that certain image forming elements comprise the same subject matter presented with a common appearance, for example, swing 14' and child 16' take on generally the same shape and orientation as that shown in FIG. 1(*a*). Other second image forming elements, such as cat 18', dog 20' and star 30' are common in theme but are shown in modes or activities in FIG. 1(*b*) different than those shown in FIG. 1(*a*). For example, dog 20, 20' is shown in generally the same region of product 10 but in a different state of activity. Dog 20 is laying down resting in FIG. 1(*a*) while the same dog 20' is chasing a star 38' in FIG. 1(*b*). Cat 18 is shown in FIG. 1(*a*) as leaping to catch butterfly 22. In FIG. 1(*b*), cat 18' is shown sitting on moon 36'. Star 30, 30' is in the same location but, in FIG. 1(*b*) is modified in size and appearance.

With reference to FIG. 1(*c*), it may now be appreciated that the first image is constructed to define regions of light and dark color and, to this end, in this first exemplary embodiment, the first or primary image is formed of a first material, such as ink printing, that is visible in ambient light. This first material may be color printing so that light and dark regions are provided, as diagramically shown in FIG. 1(*c*). With reference to that figure, it may be seen that tree 12 representively includes a dark pgmented region 40 and a light pigmented region 42 that includes limb portions 44 and 46. Light pigmented region 42 includes light colored sky region 48. Light pigmented ground region or land 50 extends between dark pigmented ground or land region 52 and background region 54. A dark background sky region 56 is also provided with this dark background sky region 56 being divided into three portions by limb regions 44 and 46.

As described more thoroughly below, the secondary image is created by overlaying the first image with a substantially clear phosphorescent material. With reference to FIG. 1(*c*), it may be first seen that the second image forming elements (shown in phantom) overlay the first image predominantly in those regions that are light colored. For example, dog 20' is located in light pigmented ground region 50. Stars 34' are located in the light pigmented tree portion 42, and moon 36' is located primarily in light pigmented tree limb portion 44. Swing 14' and person 16' are located in light pigmented sky region 48, as is star 30'. This condition, while not an absolute requirement, is desirable although, for illustrative purposes, it may be seen that cat 18' is located in dark pigmented sky region 56. Stars 34' are located in light pigments tree region 42.

It may be further observed that boundary portions of the first and second image forming elements are sometimes co-extensive. Thus, again for illustrative purposes, it may be seen that swing 14' and person 16, 16' have virtually identical boundaries. Moon 36' has co-extensive boundary portions with tree limb 13 and dog 20, 20' has certain boundary portions that are co-extensive. Other elements have no co-extensive boundaries, such as stars 34'.

It has been found that better luminescence is observed for view where the phosphorescent material overlays predominately the light pigmented areas as opposed to the dark pigmented areas of the first, primary image. To this end, "light pigmented" regions are those wherein either the intensity of color is relatively low or where the shade of the color is relatively light. These regions would include, for example, white, yellow, light green, light blue, lavender, pink, tan and light orange. On the other hand, dark pigmented regions would be blacks, browns, dark violets, dark blues, dark greens and dark reds.

Figure 2:
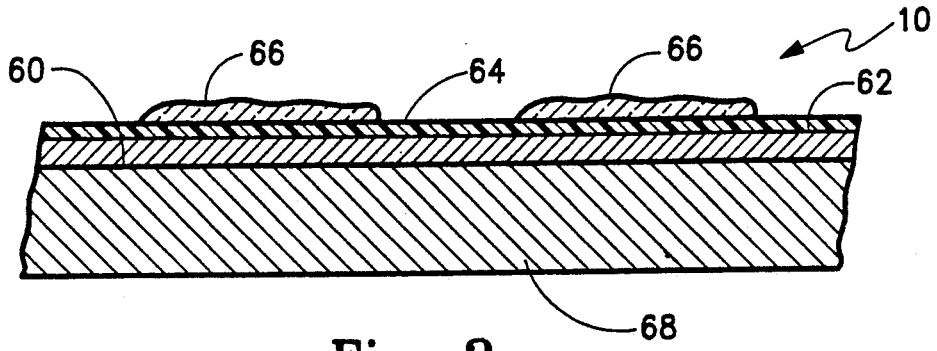
FIG. 2 is a cross-sectional view of the product shown in FIGS. 1(*a*) and 1(*b*) showing the different layers thereof.

Turning next to FIG. 2, it may be seen that product 10 is formed as a plurality of several layers. A substrate 60 as the first image disposed thereon in at surface 62. An intermediate layer 64 provides a bonding layer, as described below, and second material 66 which forms the secondary image is disposed on bonding layer 64. Substrate 60, if desired, is laminated to a backing panel 68. If desired, this assembled product 10 may then be cut into a plurality of pieces 72 to form a puzzle, such as puzzle 70 illustrated in FIG. 1(*d*). This cutting can be accomplished by a standard die cut apparatus, as is known in the art.

As noted above, second material 66 overlays the first or primary image. Accordingly, in order that the first image be viewable in ambient light, it is important that second image forming material 66 be substantially clear. Further, in order to luminesce in the visible spectrum, second image forming material 66 must also include a phosphorescent material which is excited by the presence of ambient light, including daylight and artificial light. In the preferred embodiment, a suitable material has been found in the form of phosphorescent pigment, P-1000, available from Canrad-Hanovia Inc., of Newark, N.J., U.S.A. and sold under the trademark Lumilux. This phosphorescent pigment is in the form of a finely powdered crystalline material which may be mixed with a relatively transparent carrier compound to exhibit the properties desired in the present invention. Other phosphorescent pigments based on zinc sulphides, zinc cadmium sulphides and alkaline-earth sulphides are believed suitable as well, as is known in the art.

Since the present invention is directed to products for use with children, it is important that any pigment selected, as well as the carrier compound, be a non-toxic substance. In selecting a phosphorous pigment, it is also important to select one wherein the resulting material will exhibit persistence after removal of the source of excitation daylight or artificial light. This material has a decay rate sufficiently low so that it visibly luminescences one hour after removal of the source of excitation. This is desirable again, for use with children since the secondary image will be visibly perceivable to the child for at least one hour after the removal of ambient light. This allows a sufficient interval of time for the child to enter a condition of sleep.

As noted above, the carrier compound used for the phosphorous and crystals should be a clear material. Preferably, the carrier compound is a clear polyurethane resin in which is entrained the phosphorescent crystals. Other suitable compounds that may act as a carrier can be selected from a group consisting of clear enamels, varnishes, polyvinylchlorides and polymers as well as any other clear carrier compound as would be known in the art. It has been determined that maximum brightness and persistence for the luminescent material is obtained when the phosphorescent crystals are mixed with a polyurethane resin in a proportion of approximately 30% by weight of the powered crystals. Further, it has been found that the weight percent of the compound should comprise at least 5% of the phosphorescent crystals. Where the proportions are reduced below 5%, the second image forming material does not exhibit suitable intensity of luminescence. However, increasing the weight percent of the crystals above 30% did not result in noticeable increase of the luminescent properties while at the same time made the second material more opaque and costly. Accordingly, the most suitable ratio of weight percentage of crystals to carrier compound has been found to be 5%–30% by weight of the phosphorescent crystals.

Insofar as the construction of substrate 60 is concerned, it should be understood, again, that a variety of substrate materials are suitable and are within the scope of the present invention. For use in the production of wall hangings or puzzles 70, it is preferred that the primary image be printed in four color ink format by offset printing on a substrate which is a seventy pound coated label stock (paper). Other suitable substrates are again within the scope of the present invention and include, by way of example and not limitation, wood, cloth, leather, ceramics, vinyl and plastic films. In order to better adhere the second image forming material to the substrate, it is often desirable to provide an intermediate layer in the form of a coating over the printed label stock. This intermediate coating, such as coating 64, should be selected of a material which is compatible to bond with the carrier compound used as the base for the phosphorescent material. For example, where the carrier compound is a urethane resin, intermediate layer 64 is likewise a urethane coating. Use of urethane coating 64 and a urethane resin carrier compound causes an intimate bond between second image forming material 66, coating 64 and, in turn, substrate 60. Again, this intermediate layer should be selected from a material that is determined by the carrier compound and also which is not toxic. The resulting product can then be laminated onto backing 68 which, which respect to puzzle 70, is 100 point stock approximately 0.1 inches thick.

Figure 3A:
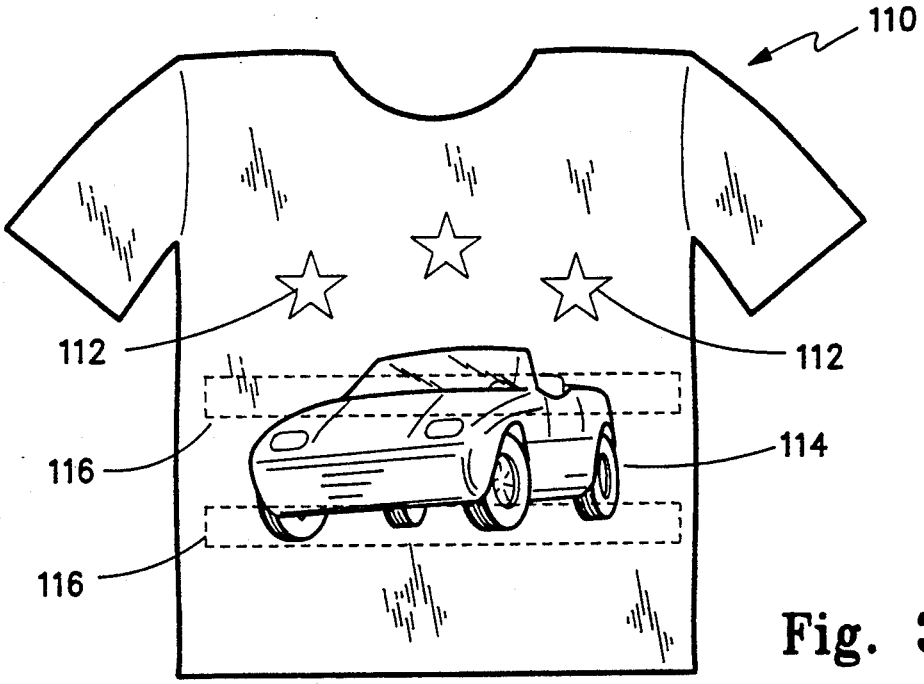
FIG. 3(*a*) shows a front view in elevation of an alternate embodiment of the present invention as it would be seen in ambient light.
Figure 3B:
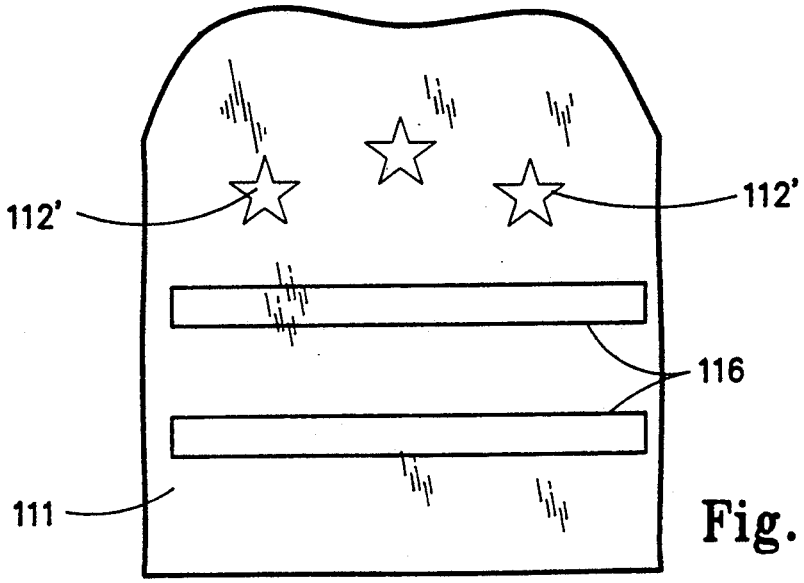

As is shown in FIGS. 3(*a*) and 3(*b*), the product according to the present invention can be used on clothing. Again, this is merely an exemplary embodiment and is in no way intended to limit the scope of this application or the claims appended hereto. A shirt 110 is shown so that the cloth material 111 forms the substrate for a first image having first image forming elements such as stars 112 and race car 114. Second image forming elements, in the form of horizontal bars 116 extend transversely across shirt 110. Bars 116 are shown in phantom in FIG. 3(*a*) and are formed by a second image forming material disposed on the cloth material 111. This second image forming material may be the phosphorescent compound discussed above. Likewise, stars 112' may be the second image forming compound directly overlaying stars 112 of FIG. 3(*a*). Thus, it may be seen that second image forming elements such as stars 112' have boundary portions that are co-extensive with the boundary portions of stars 112 which is merely a silk-screen ink printed material shirt 110. Bars 116 have some common co-extensive boundary portions with race car 114, but it may be readily seen that the boundaries of second image forming bars 116 are not in direct identical correspondence with the boundaries of race car 114. In ordinary daylight, the image shown in FIG. 3(*a*) (without bars 116), may be visibly perceived since stars 112 and race car 114 are printed out of a visibly perceivable material. In the dark, however, such as occurs after the setting of the sun, stars 112, and bars 116 luminesce as a safety device.

From the foregoing, the fabrication method according to the present invention may now be more readily appreciated and understood. This method is directed to the creation of a picture exhibiting different images in the presence and absence of ambient light, and the method comprises two fundamental steps. The first step is the producing of a primary image as a plurality of first image forming elements on a substrate. The second step then comprises overlaying the primary image with a substantially clear phosphorescent material to create a second image different from the primary image as a plurality of second image forming elements. Some of the second image forming elements may be superimposed over the first image forming elements. Thus, the primary image is visible in ambient light and the secondary image is visible in the absence of ambient light due to the luminescence of the overlaying material. This broad method may include the step of placing an intermediate layer of clear bonding material on the substrate prior to overlaying the primary image with a phosphorescent material, and the method contemplates the use of a phosphorescent material having a carrier compound and phosphorescent crystals as described above. Further, the step of overlaying the phosphorescent material onto the substrate may be accomplished by screen printing, and the step of overlaying the second image forming elements may be accomplished by making co-extensive at least some of the boundaries of the first and second image forming elements. Where this method uses a paper substrate, the step of producing the primary image may be accomplished by printing the primary image on the paper substrate, and this substrate may be cut into puzzle pieces, preferably after laminating the substrate onto a backing panel. Further, the preferred method includes the step of placing the second image forming elements predominantly on areas of light pigmented material as opposed to dark pigmented material.

With reference again to FIGS. 1(*a*) and 1(*b*), it may also be seen that the present method contemplates the communication of a common theme between the primary image and the secondary image. This primary theme may be further conveyed by script material 32 and 32'. In FIGS. 1(*a*) and FIGS. 1(*b*) it may be seen that the common theme is a child in a swing hanging from a tree and viewing the first star of the evening, in the form of star 30. After removal of ambient light, the same child is in the swing looking at star 30' now in the form of a "diamond in the sky". The swing is suspended from the moon with the child's cat sitting on the moon while his/her dog chases star 38'. The common theme thus conveyed is that of the nursery rhyme "Twinkle, Twinkle Little Star" with the child's imagination being simulated by the metamorphosis of the evening earthly scene to a nighttime celestial scene. This specific correlation, however, is described for example purposes and to clarify the meaning of the correlation of images.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A product having a picture that is viewable under different light conditions thereby to show different images, comprising:

a substrate;

a plurality of first image forming elements disposed on said substrate to create a first image that is viewable in the presence of ambient light in the visible spectrum; and a plurality of second image forming elements disposed on said substrate and overlaying said first image to create a second image different from said first image, said second image formed of a second image forming material that is substantially clear and that includes a phosphorescent material which is excited by the presence of ambient light to luminesce in the visible spectrum, whereby said second image is viewable in the absence of ambient light.

2. A product according to claim 1 wherein said phosphorescent material has a decay rate sufficiently low such that it will visibly luminesce one hour after removal of a source of excitation.

3. A product according to claim 1 wherein said second image forming material includes a clear carrier compound and phosphorescent crystals entrained therein.

4. A product according to claim 3 wherein said carrier compound is selected form a group consisting of: polyurethane resins, enamels, varnishes and polyvinyl chlorides.

5. A product according to claim 3 wherein said crystals comprise between five and thirty percent by weight of said second image forming material.

6. A product according to claim 1 wherein said substrate is selected from a group consisting of: paper, wood, cloth, leather, ceramic and plastic materials.

7. A product according to claim 1 wherein said first image is a rendering in multi-color format including light pigmented colors and dark pigmented colors, said second image forming material predominantly overlaying said light pigmented colors.

8. A product according to claim 1 wherein said first image forming elements have first boundaries and wherein said second forming elements have second boundaries, at least some of said first and second boundaries having coextensive boundary portions.

9. A product according to claim 1 wherein said substrate material is in the form of a panel that comprises a plurality of panel forming pieces so that said product is in the form of a puzzle that may be assembled and disassembled.

10. A product according to claim 1 wherein said first image is formed by a first image forming material disposed on said substrate and including an intermediate layer of a third material between said first image forming material and said second image forming material to provide an undercoat for said second image forming material.

11. A product according to claim 10 wherein said third material includes a substance compatibly bondable to said second image forming material.

12. A product according to claim 11 wherein said second image forming material is a urethane carrier having phosphorescent crystals entrained therein and wherein said third material is a urethane varnish.

13. A product according to claim 1 wherein said first image forming elements include representations of animals in a first orientation and said second image forming elements include at least some of said animals in a second orientation different from said first orientation.

14. A product according to claim 1 wherein said first and second images have a related theme represented by correspondence of first image forming elements to said second image forming elements.

15. A product according to claim 14 including textual material disposed on said substrate operative to correlate said first and second images to one another.

16. A product having a picture that shows different images in the presence and absence of ambient light, comprising:

a substrate;

a first image disposed on said substrate as a plurality of first image forming elements in a manner to create a primary image that may be observed in the presence of ambient light in the visible spectrum;

an intermediate coating of a clear undercoat material overlaying said first image on said substrate; and a second image disposed on said substrate as a plurality of second image forming elements in a manner to create a secondary image different from said primary image, said secondary image formed of a second image forming material overlaying said intermediate coating so that said secondary image overlays said first image, said second image forming material being relatively clear and including a phosphorescent material which is excited by the presence of ambient light to luminesce in the visible spectrum, whereby said second image is viewable in the absence of ambient light.

17. A product according to claim 16 including a backing panel, said substrate being laminated onto said backing panel to form a laminated substrate panel.

18. A product according to claim 17 wherein said laminated substrate panel in separated into a plurality of pieces which may be assembled and disassembled into a puzzle.

19. A product according to claim 16 wherein said intermediate coating is a urethane varnish and wherein said second image forming material includes a urethane compound entrained with a phosphorescent pigment.

20. A method of creating a picture exhibiting different images in the presence and absence of ambient light, comprising the steps of:

producing a primary image as a plurality of first image forming elements on a substrate; and overlaying said primary image with a substantially clear phosphorescent material to create a secondary image different from said primary image as a plurality of second image forming elements whereby said primary image is visible in ambient light and whereby said secondary image is visible in the absence of ambient light.

21. A method according to claim 20 wherein some of said second image forming elements are superimposed over said first image forming elements.

22. The method according to claim 20 including the step of placing an intermediate layer of clear bonding material on said substrate prior to overlaying the primary image with said phosphorescent material.

23. The method according to claim 22 wherein said phosphorescent material includes a carrier compound and phosphorescent compounds entrained in said carrier material and wherein said bonding material is adapted to compatibly bond to said carrier material.

24. The method according to claim 23 wherein said carrier material and said bonding material is urethane based.

25. The method according to claim 20 wherein the step of overlaying said phosphorescent material is accomplished by screen printing.

26. The method according to claim 20 wherein the first image forming elements have first boundaries and wherein said second image forming elements have second boundaries, the step of overlaying said primary image with said secondary image is accomplished by making at least some of said first and second boundaries coextensive.

27. The method according to claim 20 wherein the step of producing said primary image is accomplished by printing the primary image on a paper substrate.

28. The method according to claim 20 including the step of cutting said substrate into puzzle pieces after producing the primary image and overlaying the primary image with the secondary image.

29. The method according to claim 20 including the step of laminating said substrate onto a backing panel prior to cutting said substrate into said puzzle pieces.

* * * * *